United States Patent [19]

Spallholtz

[11] Patent Number: 5,035,464

[45] Date of Patent: Jul. 30, 1991

[54] SNACK TRAY ASSEMBLY

[76] Inventor: Howard Spallholtz, 95 16th St., West Babylon, N.Y. 11704

[21] Appl. No.: 503,773

[22] Filed: Apr. 3, 1990

Related U.S. Application Data

[63] Continuation-in-part of Ser. No. 416,407, Oct. 3, 1989, abandoned.

[51] Int. Cl.[5] ..... A47C 7/62

[52] U.S. Cl. ..... 297/144; 297/192; 403/115

[58] Field of Search ..... 297/144, 192, 430, 162; 5/507; 403/114–116

[56] References Cited

U.S. PATENT DOCUMENTS 1,664,893 4/1928 Meyering ..... 403/115
2,635,680 4/1953 Zentmire ..... 297/144
2,658,793 11/1953 Sinclair ..... 403/115 X
3,717,375 2/1973 Slobodan ..... 297/144 X

FOREIGN PATENT DOCUMENTS 816467 7/1969 Canada ..... 297/162
510508 10/1930 Fed. Rep. of Germany ..... 5/507

*Primary Examiner*—Peter R. Brown
*Attorney, Agent, or Firm*—Richard C. Litman

[57] ABSTRACT

A folding tray assembly that stores under a couch has pivoted joints on two arm members which allow for the table to be unfolded to a usable height for tasks such as eating or playing cards. The unitary joints have double axes of rotation that allow for easy opening and closing of tray assembly. One arm is a sliding rail member that retracts into a tube housing under the couch, taking the folded tray assembly out of view when not needed.

3 Claims, 3 Drawing Sheets

FIG. 4
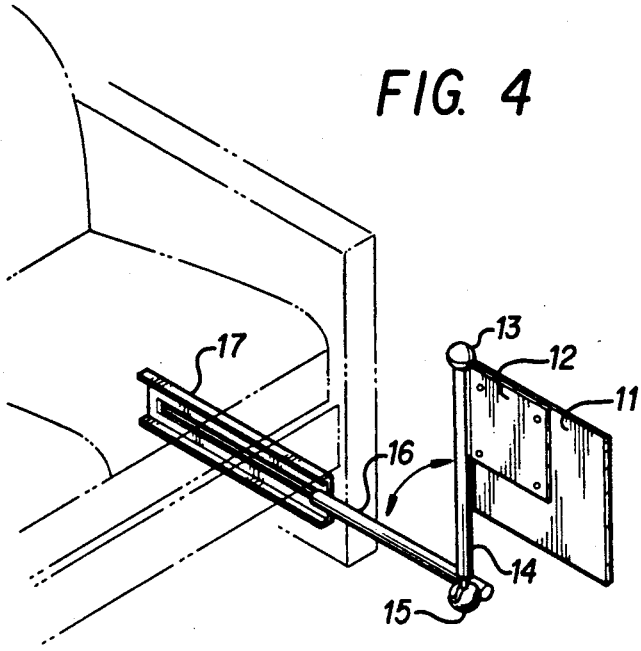
FIG. 5
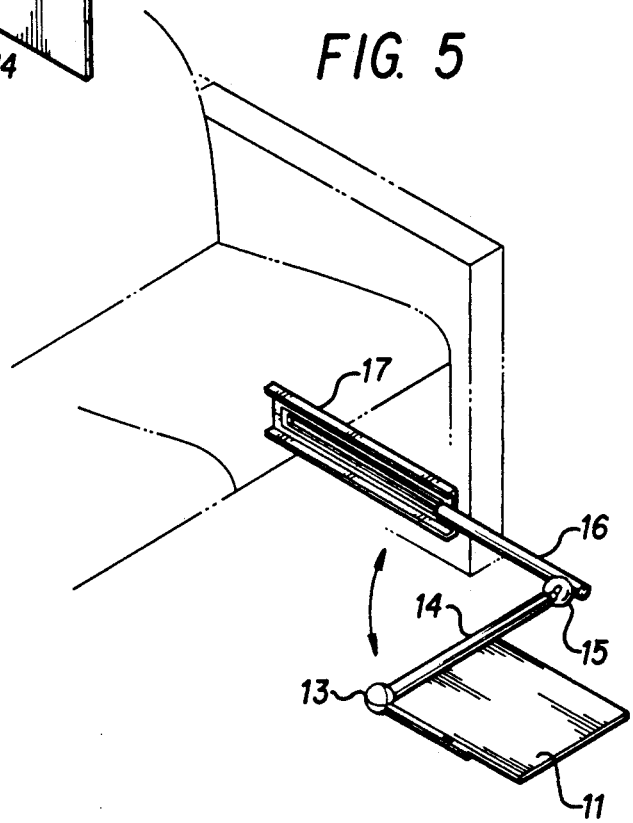
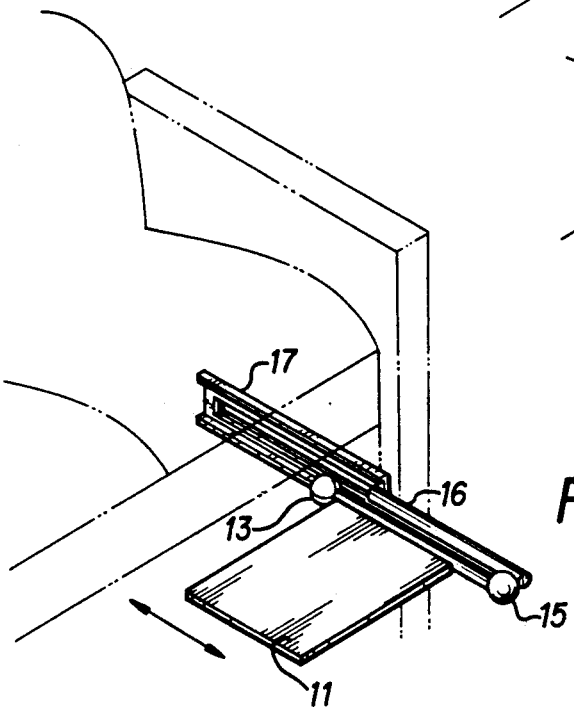
FIG. 6

SNACK TRAY ASSEMBLY

CROSS-REFERENCE TO RELATED APPLICATION

This present application is a Continuation-In-Part of application Ser. No. 07/416,407 filed Oct. 3, 1989, now abandoned.

BACKGROUND OF THE INVENTION

1. Field of the Invention

The present invention relates to special tray or table assemblies. More specifically, the invention relates to a snack tray that is mounted upon pivoting arms that allow it to be opened up from a storage position, such as under a couch. Usually, when one wants to eat while watching television or to play cards with one person sitting on a sofa, a separate table has to be used and placed in front of the couch or sofa. If a table isn't used it means putting things on the unstable surface of the couch. Either way of doing things means inconvenience, especially when having to fetch a table. It would be a much simpler if the table were right at the disposal of the person already seated on the couch.

Description of the Prior Art

The following patents are felt to be related to the present invention, but in no way disclose, whether singly or in combination, the present invention.

U.S. Pat. No. 3,717,375 issued to Slobodan discloses a folding table that stows away under a couch or chair. This device uses a cumbersome joint system that involves a large number of moving parts that have to be managed and locked into place.

U.S. Pat. No. 1,862,237 issued to Pepler discloses a bed table that can be concealed under the bed frame. This patent only discloses one arm. This patent also does not have the sliding rail of the present invention, allowing the device to be completely stored from view.

U.S. Pat. No. 569,914 issued to Field discloses a typewriter desk which can slide on carriage rails. This device has no provision for the pivoting arms of the present invention. Also this device maintains the typewriter and desk on a constant level.

U.S. Pat. No. 4,341,418 issued to Chappell discloses a hideaway table, the tray section of which can be pulled up from under a seat. This seat section cannot be used to sit on while the tray is out because the tray rests on top of the seat. The present invention allows a person to sit on a couch with the tray out in front of him.

SUMMARY OF THE INVENTION

The present invention allows for the storage of a tray under an article of furniture such as a couch or sofa. When a person desires to use the tray, it can be taken from beneath the couch so that it is in front of a person sitting on the couch at a usable level for certain tasks such as eating or playing cards with a person seated across from the person seated on the couch. The tray can be quickly and easily returned to its storage position beneath the couch.

The tray is connected to a system of pivoting arms that allow for the tray to be collapsable from the upright position. One arm is slidably mounted in a tube that is mounted under the couch. By folding the pivoting arms down into a compact flat form with the tray, the whole assembly can then be slid beneath the couch and out of sight.

The assembly has two arms rotatably connected to each other. The table is rotatably connected to the end of an outer arm. The second arm is slidably mounted to the frame of the couch. The rotating joints have two axes of rotation to allow the assembly to be completely collapsed down.

Accordingly, it is one object of the present invention to provide a storable tray assembly that can be stored beneath a sofa or couch.

It is another object of the present invention to provide a tray assembly that is an integral part of a couch or sofa.

It is a further object of the present invention to provide a tray assembly that can be raised from beneath a sofa or couch to a level useful to a person seated on the couch.

It is still a further object of the present invention to provide a tray assembly that has multiple pivoting arms.

It is a yet further object of the present invention to provide a tray assembly that can be stored out of sight and completely out of the way of a person sitting on a couch when not in use.

These and other objects of the present invention will become readily apparent upon further review of the following specification and accompanying drawings.

BRIEF DESCRIPTION OF THE DRAWINGS

FIG. 4 shows the tray in another perspective view of a partially folded position.

FIG. 5 shows the tray in another perspective view in a partially folded position prior to the folding of the arms.

FIG. 6 shows the the tray assembly in perspective prior to its being pushed beneath the couch.

Similar reference characters denote corresponding features throughout the drawings.

DETAILED DESCRIPTION OF THE PREFERRED EMBODIMENT

Figure 1:
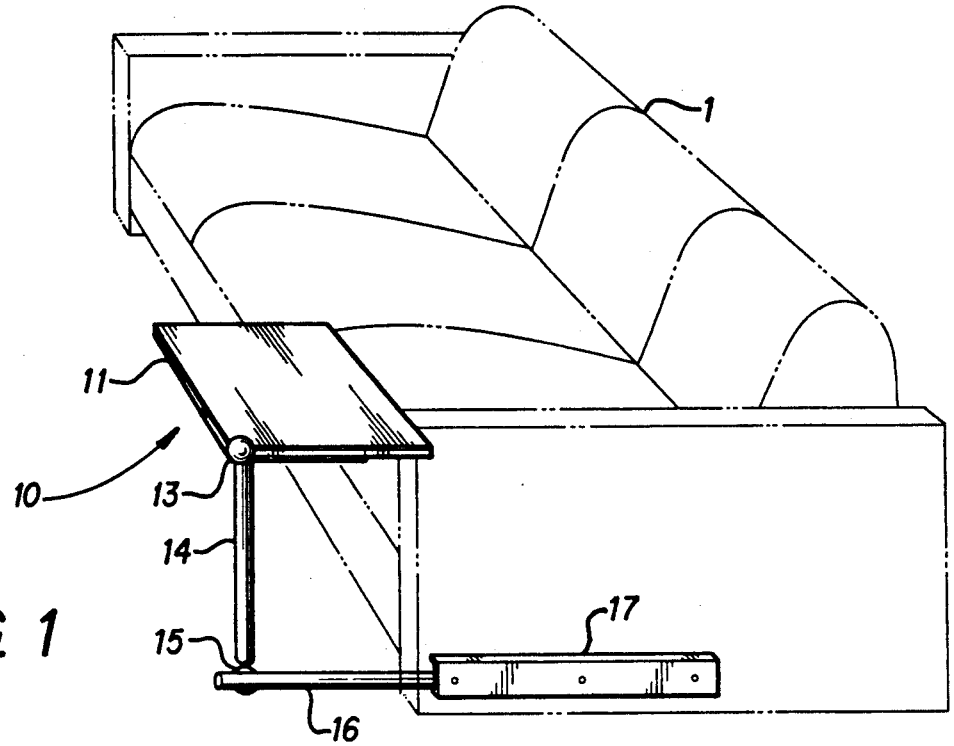
FIG. 1 shows perspective view of the tray in the upright position.
Figure 7:
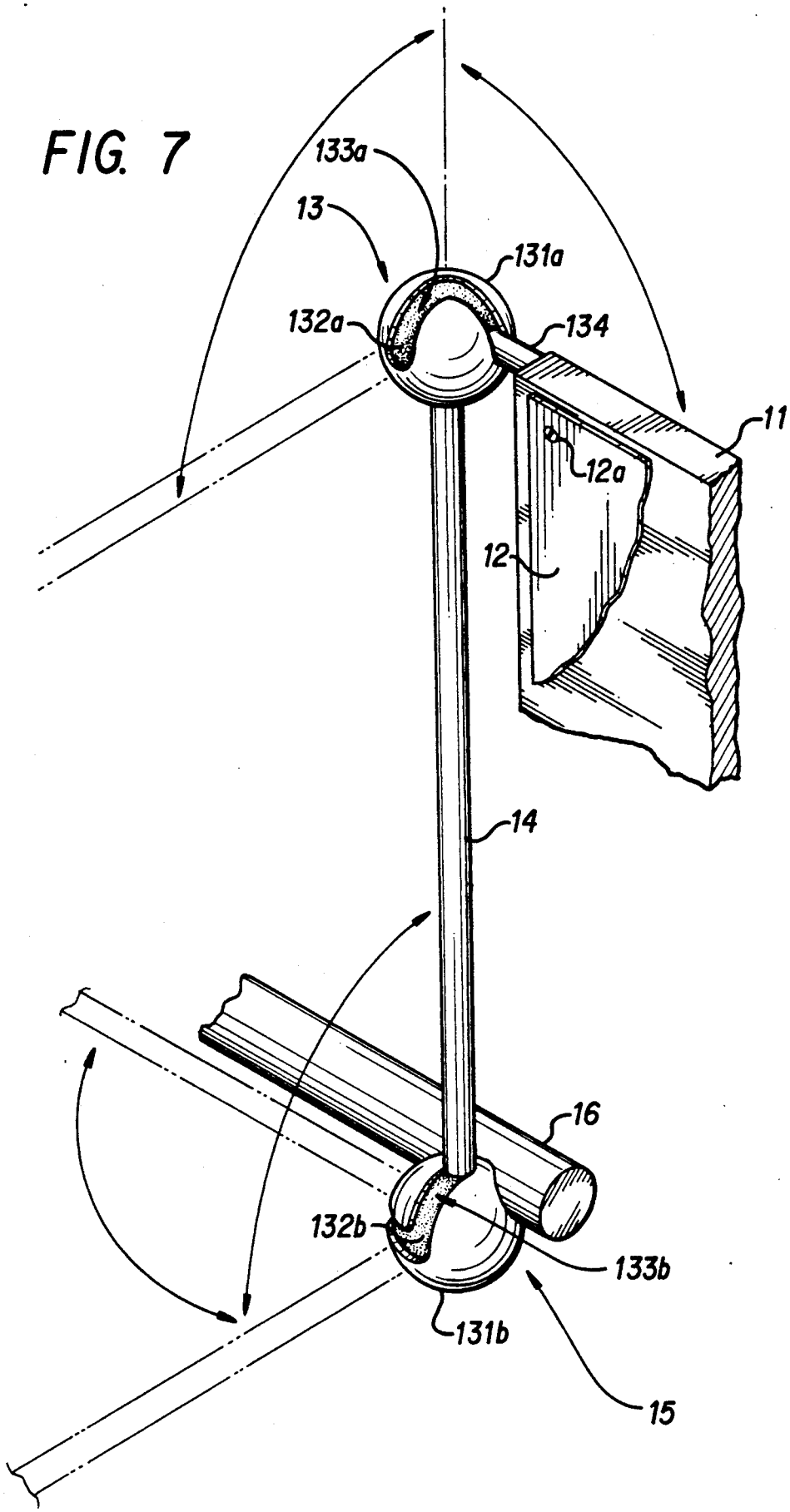
FIG. 7 is a perspective view showing the details of the hinge mechanism used by the folding tray.

The tray assembly 10 is shown in FIG. 1 in the full upright position. The assembly consists of a flat table tray 11 mounted to a metal tray support plate 12. The tray 11 and support plate 12 can be mounted together with conventional screws 12*a*. The tray 12 is connected by a support member or arm 134 to the rotating joint 13 as best shown in FIG. 7. This joint 13, which serves to connect the plate 12 to the arm 14, has two axes of rotation. The axes of rotation of the joint 13 are substantially normal to one another. This allows for the tray 11 to be moved up and out of the way of the user sitting on the sofa 1. It also aids in the storage procedure of the tray assembly 10.

The arm 14 is connected to a similar joint 15, at its opposite end, having double axes of rotation. Connected to the arm 14 and joint 15 is a second arm or rail 16 that slides along a guide rail 17. The guide rail 17 can be bolted or screwed to the couch frame. The plurality of rotatable joints 13,15 allows the tray assembly 10 to be folded in the manner shown in FIG. 2. The preferred joints 13,15 are of a ball and socket type best shown in FIG. 7. Each joint 13 and 15 comprises an outer shell or socket 131*a,b* having a spherical ball 132*a,b* disposed within it. The spherical ball 132*a,b* freely sits within the socket 131*a,b* and can rotate in the direction allowed by a track or slot 133*a,b* placed on through the surface of the socket 131*a,b*. Arm 14 is solidly attached to ball 132*b* and disposed through the track 133*b*. Arm 14 is solidly affixed to socket 131*a*. Arm 14 can be screwed into the ball 132*b* to firmly secure it. Track 133*b* has a two leg shape that allows the ball 132*b* and arm 14 to rotate first in a downward direction and then in a horizontal movement. Similarly, tray 11 is attached to the ball 132*a* by member 134. Member 134 is affixed to ball 132*a* by a screw joint. Track 133*a* allows the tray 11 to be rotated in two directions.

To provide a friction fit between socket 131*a,b* and the ball 132*a,b* a compressed rubber seal can be disposed between the inner surface of the socket 131*a,b* and the outer surface of the ball 132*a,b*. This seal provides enough frictional resistance to allow the arm and tray to stand upright in a vertical position without falling down. The ball and socket assemblies 13 and 15 allow the tray to be unfolded in one continuous movement by providing only one moving joint for each section of the device 10.

Figure 2:
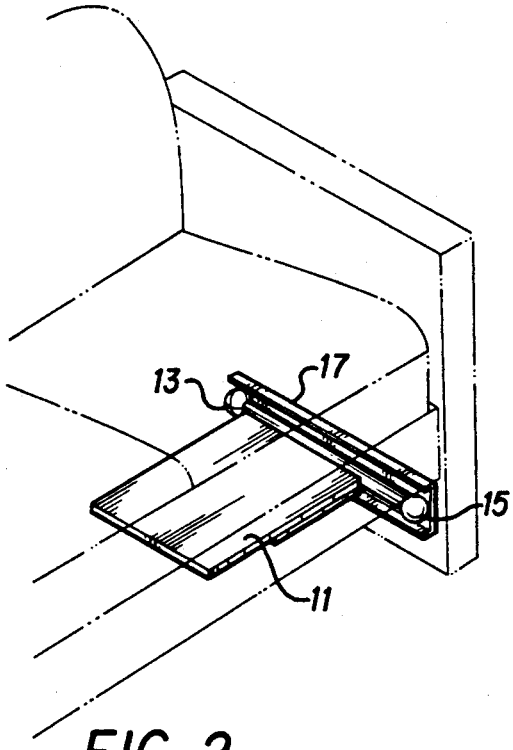
FIG. 2 shows a perspective view of the tray in the folded storage position beneath a couch.
Figure 3:
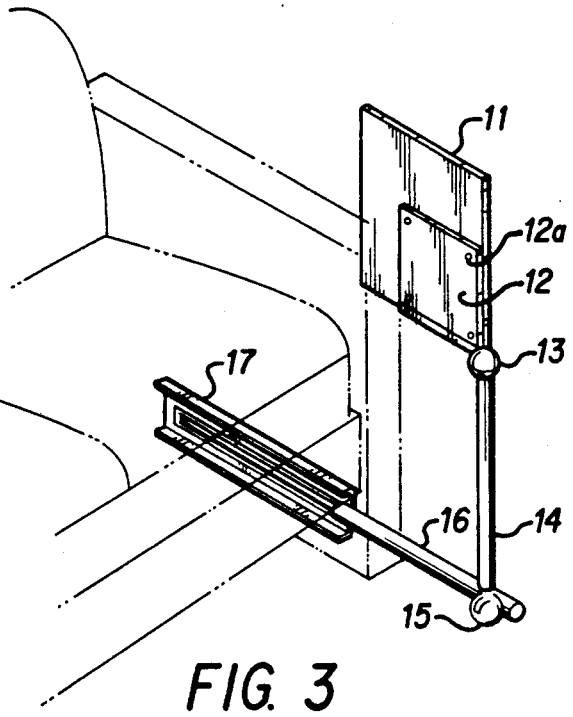
FIG. 3 shows in perspective the tray in a partially folded position.

By having the tray assembly beneath the couch 1, it remains out of the way when not needed. FIGS. 3 and 4 show the initial steps for the method of folding the tray assembly 10 down to a fully stored condition as shown in FIG. 2. From the standing position of FIG. 1 the tray table 11 and support plate 12 are first pivoted up and then rotated forward. The arm 14 is then rotated downward so that the arm 14 and rail 16 lay in the same horizontal plane as is shown in FIG. 5. The arms 14 and 16 are then pivoted together so that they lay adjacent each other, such as shown in FIG. 6. The whole assembly 10 is then pushed inward, beneath the couch or sofa 1, the rail 16 slidably engaging guide rail 17.

As can be seen, the whole tray assembly 10 can be easily stored out of sight. With the present tray assembly 10 there is no need to keep a separate table. To use the tray 11, it is only necessary to reverse the above-described process.

It is to be understood that the present invention is not limited to the sole embodiment described above, but encompasses any and all embodiments within the scope of the following claims.

I claim:

1. A folding tray assembly adapted for storage beneath a piece of furniture, said tray assembly comprising:

a tray;

a support arm rotatably connected at one end to said tray;

sliding rail means rotatably connected to an opposite end of said support arm; and rail housing means mounted on the underside of said piece of furniture for slidably engaging said rail means, allowing said rail means to slide in and out of said rail housing means;

said tray and said sliding rail means being rotatably connected to said support arm at opposite ends by unitary joints, each unitary joint having two axes of rotation substantially normal to one another and comprising a hollow spherical socket and a spherical ball disposed within said spherical socket, one said ball having said arm attached to it and the other said ball having said tray attached to it, each said spherical socket having a double legged slot disposed therethrough to provide a pathway for said arm and said tray to follow such that said tray assembly can be unfolded to an upright position and folded into a compact configuration for storage beneath said piece of furniture.

2. The folding tray assembly according to claim 1 including a compressed rubber seal disposed between said spherical socket and said spherical ball to provide sufficient frictional resistance for allowing said arm and tray to stand in said upright position.

3. The folding tray assembly according to claim 1 wherein said piece of furniture is a sofa.

* * * * *